US006192797B1

(12) United States Patent
Rea et al.

(10) Patent No.: US 6,192,797 B1
(45) Date of Patent: Feb. 27, 2001

(54) INK CARTRIDGE FOR AUTOMATED DISPENSING SYSTEMS

(75) Inventors: Keith R. Rea; James W. Lowry, both of Florence, SC (US); James F. Kick, Town & Country, MO (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 09/470,747

(22) Filed: Dec. 23, 1999

(51) Int. Cl.[7] ..... B41F 31/08
(52) U.S. Cl. ..... 101/202; 101/210; 101/366
(58) Field of Search ..... 101/366, 363, 101/364, 350.1, 207, 208, 209, 210, 351.8, 365, 148, 202; 222/326, 327

(56) References Cited

U.S. PATENT DOCUMENTS

| | | | | |
|---|---|---|---|---|
| 2,090,111 | | 8/1937 | Creveling . | |
| 2,649,999 | | 8/1953 | Burch . | |
| 2,661,126 | | 12/1953 | Spencer . | |
| 3,029,987 | | 4/1962 | Gronemeyer . | |
| 3,241,726 | | 3/1966 | Chester . | |
| 3,321,108 | | 5/1967 | Bowe . | |
| 3,884,396 | | 5/1975 | Gordon et al. . | |
| 4,269,330 | | 5/1981 | Johnson . | |
| 4,331,267 | | 5/1982 | Duncan et al. . | |
| 4,356,935 | | 11/1982 | Kamin . | |
| 4,373,646 | | 2/1983 | MacEwen . | |
| 4,402,427 | * | 9/1983 | Muskovin et al. | 222/47 |
| 4,432,473 | | 2/1984 | MacEwen . | |
| 4,913,323 | | 4/1990 | Scheindel . | |
| 4,949,875 | | 8/1990 | Kuo . | |
| 5,411,182 | * | 5/1995 | Marte et al. | 222/386 |
| 5,535,924 | | 7/1996 | Nilsson et al. . | |
| 6,089,412 | * | 7/2000 | Snell et al. | 222/309 |

* cited by examiner

*Primary Examiner*—John S. Hilten
*Assistant Examiner*—Kevin D. Williams
(74) *Attorney, Agent, or Firm*—Bullwinkel Partners, Ltd.

(57) ABSTRACT

An improved cartridge for dispensing highly viscous fluids in which the nozzle is recessed for ease of packaging, shipping and storing. The cartridge comprises a hollow cylindrical body, a plunger and a dispensing fitment. The cylindrical body holds a supply of extrudable fluid contents such as lithographic ink. The plunger serves as a pneumatically activated piston within the cylindrical body to extrude the contents of the cartridge. The nozzle has an open and a closed position. In the closed position the nozzle does not protrude beyond the top of the dispensing fitment. The dispenser may also include a detachable nozzle extension which, when attached to the nozzle, extends beyond the top of the fitment.

5 Claims, 2 Drawing Sheets

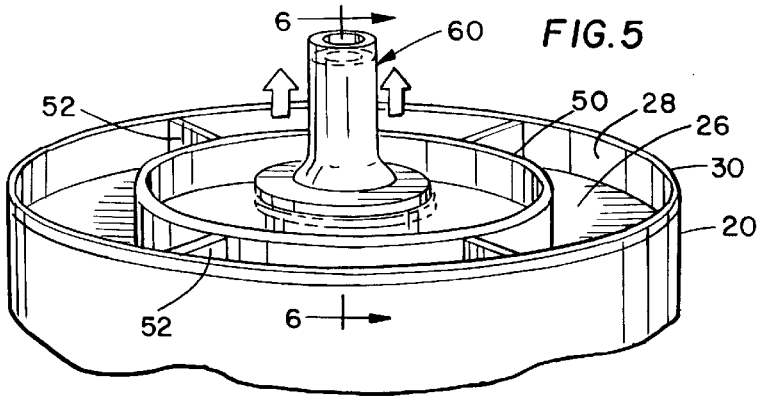
FIG. 5
FIG. 4
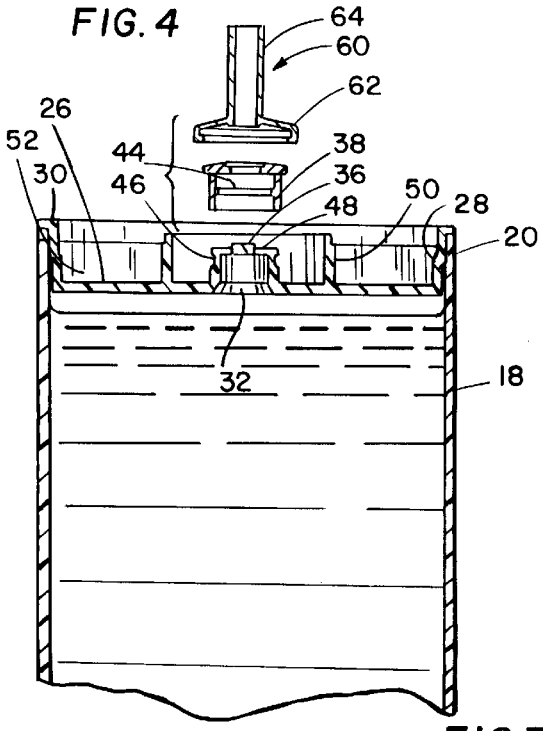
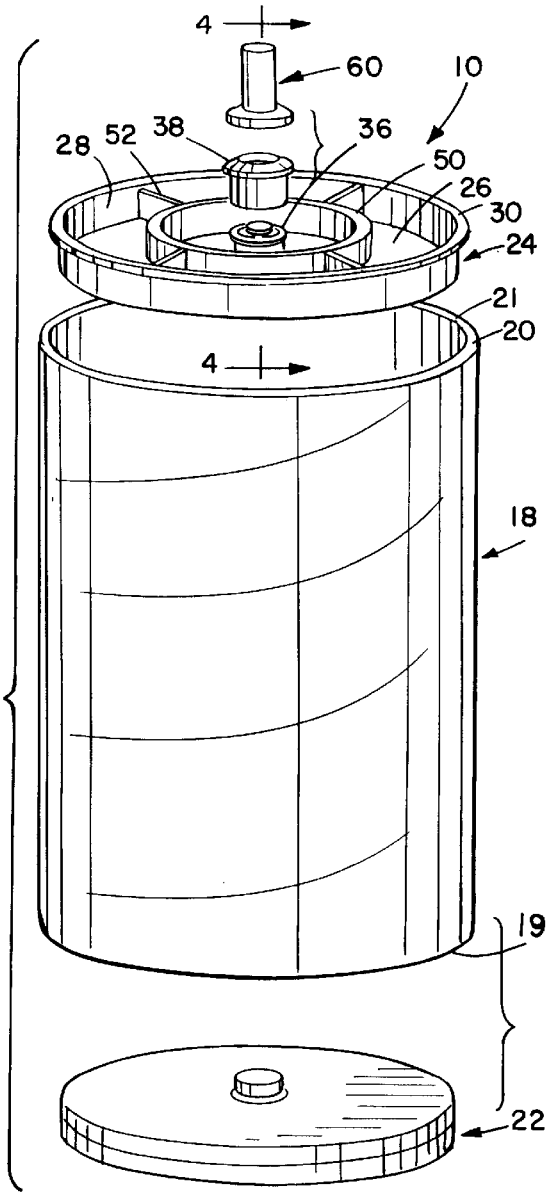
FIG. 3
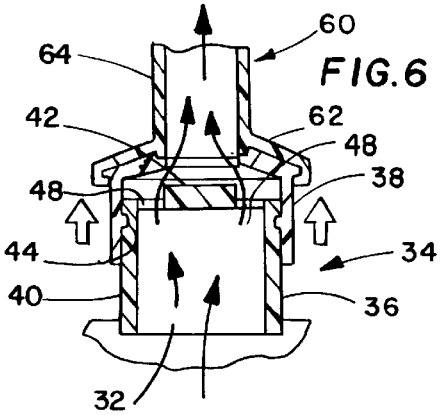
FIG. 6

INK CARTRIDGE FOR AUTOMATED DISPENSING SYSTEMS

BACKGROUND

1. Field of the Invention

This patent relates to liquid dispensing cartridges for automated dispensing systems. More specifically, this patent relates to an ink dispensing cartridge for use with a sheet fed lithographic press.

2. Description of the Related Art

Lithography is a printmaking process dating back to the 1700s in which ink is applied to a plate having both image and nonimage areas. The image areas are ink-receptive and water-repellent. The non-image areas are water-receptive and ink-repellent. In rotary type presses the plate is mounted on a cylinder that rotates during printing. In one typical configuration, the plate cylinder picks up the ink at the image areas and transfers the image to a blanket cylinder which in turn transfers the image to the paper.

In multi-color sheet-fed presses, up to ten inking stations can be placed in series. Each station has its own ink feeding system and handles a separate color. As the paper sheet moves from station to station, a new color is put down at each station.

Because lithographic ink is thixotropic and very viscous, conventional lithographic ink feeding systems require a complex system of drums, vibrators and fountain rollers. In a typical lithographic ink feeding system, workers remove lithographic ink from a drum (or, in some cases, smaller tins) with specially made spatulas and spread the ink across a tray (the ink fountain). Fountain rollers roll against the ink fountain to pick up the ink and transfer it to the plate cylinder. The process is labor intensive and subject to error.

Storing lithographic ink in drums can result in wasted ink if the entire drum is not used because it is difficult to store and reuse ink in drums. The lithographic ink itself is prone to oxidation which can result in color variations from one press run to another, and even from sheet to sheet within a single run. In addition, upon exposure of the ink to the atmosphere, volatile organic compounds (VOCs) evaporate which can cause ink spoilage.

Thus there exists a need for an improved system of storing and dispensing ink for sheet fed lithographic presses. The present invention solves this need by providing an ink cartridge that is easy to fill and ship and can be used with sheet fed lithographic presses of the type that dispense ink from a dispenser mounted over the ink fountain or the fountain roller. During use the ink cartridge moves back and forth across the fountain, dispensing ink into the fountain or directly onto an ink form roller to provide an even consistent layer of ink. In automated presses, the amount of ink in the fountain is continually monitored and replenished as needed.

Numerous cartridge-type dispensers are known in the art, such as those disclosed in Bowe U.S. Pat. No. 3,321,108, MacEwen U.S. Pat. No. 4,373,646 and Nilsson et al. U.S. Pat. No. 5,535,924. However, neither these patents nor any others known to the inventors disclose a cartridge useful for dispensing lithographic ink that can readily be sealed and then reused without wasting a substantial amount of the dispensing material.

Furthermore, conventional cartridge-type dispensers often have built-in protruding nozzles that make it difficult to package, ship and store the cartridges. For example, if the cartridges are shipped in cartons in a vertical position (i.e. standing up), the top of the cartons must be reinforced to prevent the top from collapsing and damaging the cartridge nozzles. If the cartridges are shipped in a horizontal (lying down) position, the sides of the cartons must be suitably reinforced and the cartridges held stationary within the package. The protruding nozzles also prevent stacking of the cartridges either before or after use.

Thus it is an object of the present invention to provide an ink cartridge for easy storing, transporting and dispensing of lithographic ink.

Another object of the present invention is to provide an ink cartridge that can be used in a sheet fed lithographic press to dispense a controlled amount of ink onto an ink fountain.

Still another object of the present invention is to proved an ink dispensing cartridge that minimizes exposure of the ink to the atmosphere.

Yet another object of the present invention is to provide an ink cartridge that can be resealed and reused with the ink remaining stable as to viscosity and color.

Yet another object of the present invention is to provide an ink cartridge which minimizes the amount of residual ink left in the cartridge after use.

Yet another object of the present invention is to provide an ink cartridge having a recessed nozzle for ease of packing, shipping and storing.

Yet another object of the present invention is to provide an ink cartridge having a removably attached nozzle extension for better control of fluid flow.

Yet another object of the present invention is to provide an ink cartridge having a composite body with multiple liner options to meet a user's performance requirements for various inks.

Further and additional objects will appear from the description, accompanying drawings, and appended claims.

SUMMARY OF THE INVENTION

The present invention is an ink cartridge, particularly one for use with sheet fed lithographic presses, that can be easily filled, transported, used and reused. The cartridge minimizes exposure of the ink to the atmosphere and also minimizes the amount of residual ink left in the cartridge after use. The cartridge comprises a hollow cylindrical body, a plunger and a dispensing fitment. The cylindrical body holds a supply of ink or other extrudable material and has a dispensing end and a plunger end. The plunger end is sealed by the plunger which serves as a piston within the cylindrical body to extrude the contents of the dispenser when the plunger is forced toward the dispensing end by, for example, pneumatic pressure. The dispensing end terminates in a rim.

The cartridge is provided with a dispensing fitment which is mounted in sealing engagement with the dispensing end of the cylindrical body. The dispensing fitment comprises a substantially circular disk, an annular side wall formed around the periphery of the disk and extending upwardly therefrom and terminating in a top end, and a closure flange extending radially outwardly from the top end of the annular side wall. When the dispensing fitment is inserted into the cylindrical body the closure flange abuts the rim at the dispensing end. The closure flange defines a plane which essentially is the top of the dispenser.

A substantially circular aperture is located at the center of the dispensing fitment. A reclosable nozzle is attached to the dispensing fitment over the aperture. The nozzle has an open and a closed position. In the closed position the nozzle does not extend beyond the plane of the flange. The dispenser may also include a detachable nozzle extension which, when attached to the nozzle, may extend beyond the plane of the closure flange.

The ink cartridge of the present invention is an improvement over conventional lithographic ink drums because the cartridge minimizes exposure of the ink to the atmosphere and can be resealed and reused. And because the ink cartridge has a recessed nozzle, the cartridge is better suited for packaging, shipping and storing ink than conventional cartridges.

BRIEF DESCRIPTION OF THE DRAWINGS

FIG. 3 is an exploded perspective view of the ink cartridge of FIG. 2;

FIG. 4 is a cross-section taken along line 4—4 of FIG. 3;

FIG. 5 is an enlarged perspective view of the dispensing end of the ink cartridge of FIG. 2; and FIG. 6 is a cross-section taken along line 6—6 of FIG. 5.

DETAILED DESCRIPTION OF THE INVENTION

Figure 1:
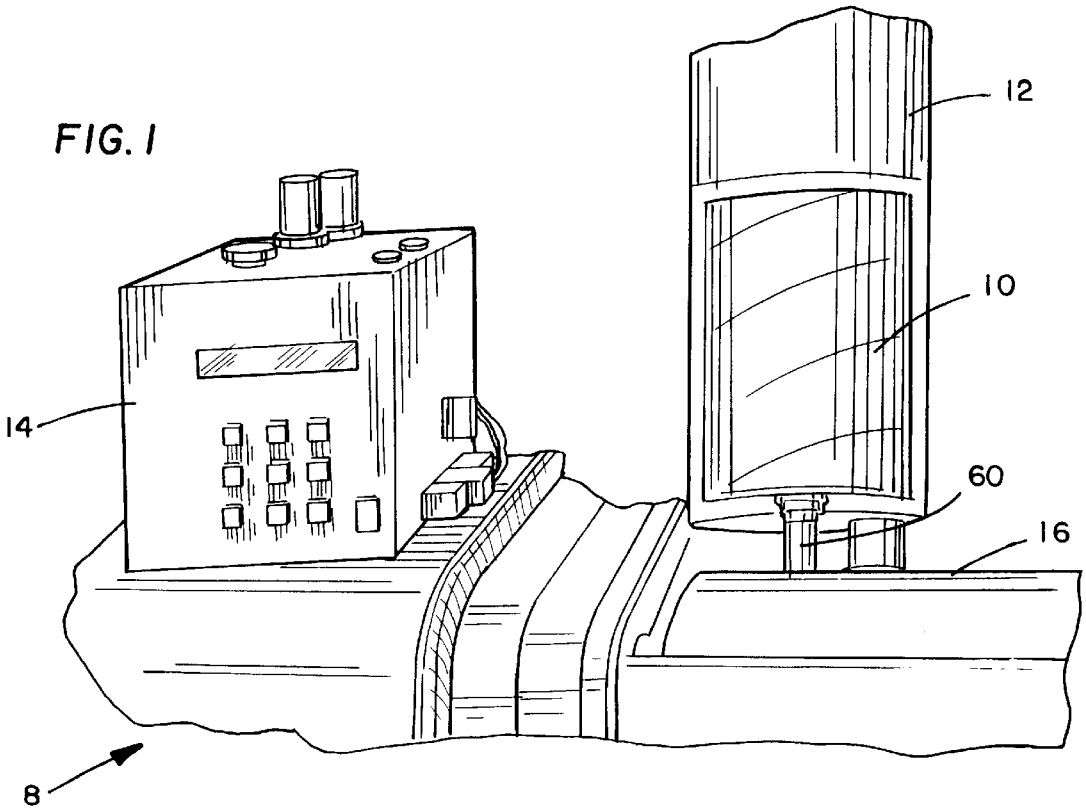
FIG. 1 is a perspective view of an automated ink dispensing system showing an ink cartridge according to the present invention installed in a cartridge carriage in an inverted position.
Figure 2:
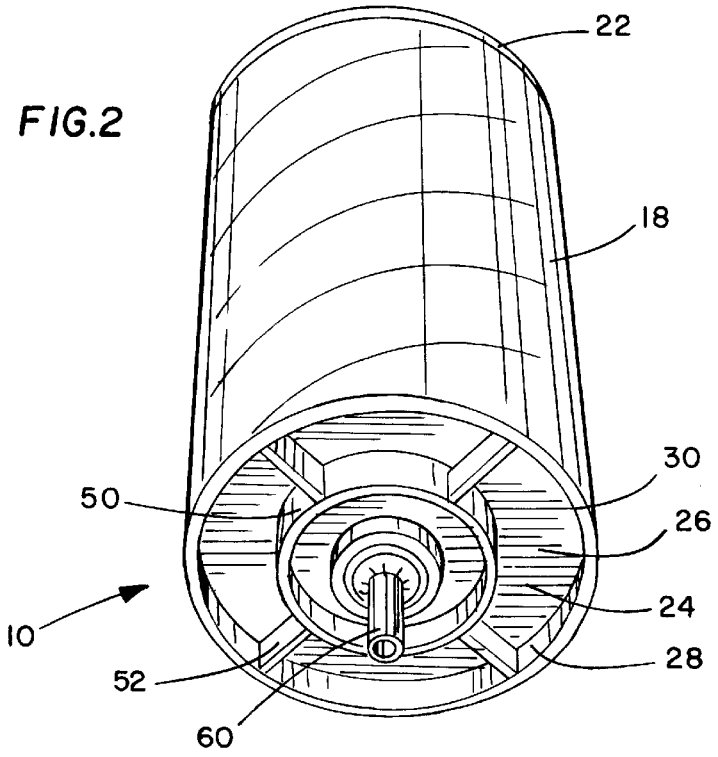
FIG. 2 is a perspective view of an ink cartridge according to the present invention.

Turning to the drawings, there is shown in FIG. 1 a perspective view of an automated ink dispensing system 8 for use with a sheet fed lithographic press. The ink dispensing system 8 includes an ink cartridge 10 according to the present invention mounted in an inverted position within a cartridge carriage 12 and an ink dispensing controller 14 for controlling the amount of ink dispensed. During operation the carriage 12 moves laterally along the length of a fountain roller 16 while an ink level sensor constantly monitors the amount of ink in the fountain roller 16 to determine the exact locations where ink is needed. When a low level of ink is detected by the sensor, the controller 14 activates an air supply which forces air against the pneumatically controlled plunger 22 to dispense ink where it is needed to maintain an even layer of ink on the roller 16.

The ink cartridge 10 of the present invention was specifically designed to work with automated ink dispensing systems of the type just described. The ink cartridge 10 is shown in detail in FIGS. 2–6, and comprises a hollow cylindrical body 18 having a bottom end 19 and a top end 20, a plunger 22 inserted into the bottom end 19 for sliding engagement with the inside wall of the cartridge body 18, and a dispensing fitment 24 mounted in sealing engagement with the top end 20 of the cartridge body 18. In the preferred embodiment the dispensing fitment 24 is glued to the cartridge body 18. The top end 20 of the cartridge body terminates in a rim 21.

Preferably, the cartridge body 18 is made of convolutely wound paper lined internally with polymeric material, although any suitable materials may be used, including, depending on the application, metal or plastic. In the preferred embodiment the plunger and the dispensing fitment are made of plastic. In practice the ink cartridges 10 are approximately nine or thirteen inches long, but any suitable length may be used depending on need and the dimensions of the cartridge carrier.

The dispensing fitment 24 is generally cup-shaped and comprises a substantially circular disk 26 and an annular side wall 28 formed around the periphery of the disk 26 and extending upwardly therefrom (upward being defined as the direction away from the bottom end 19). A closure flange 30 extends radially outwardly from the top end of the annular side wall 28. When the dispensing fitment 24 is fully inserted into the cylindrical body 18, the closure flange 30 abuts the rim 21 of the cylindrical body 18 to prevent further insertion of the fitment 24.

A substantially circular aperture 32 is located at the center of the circular disk 26. A nozzle 34 is attached to the circular disk 26 over the aperture 32. The nozzle 34 is conventional in design and comprises a hub 36 and a cap 38. The hub 36 comprises a substantially cylindrical side wall 40 extending upwardly from the perimeter of the circular aperture 32 and a plug 42 centrally disposed over the aperture 32 and connected to the side wall 40. The diameter of the plug 42 is less than that of the diameter of the top of the hub side wall 40 so as to cover some, but not all, of the opening defined by the top of the side wall 40.

The nozzle cap 38 fits over the hub 36 in sliding engagement therewith. The nozzle cap 38 has a radially inwardly extending flange 44 which travels within an annular groove 46 disposed in the outside of the hub side wall 40. When the nozzle cap 38 is in the lower or closed position, the cap 38 mates with the plug 42 to prevent the outward flow of the cartridge contents. When the nozzle cap 38 is in the extended or open position, openings 48 around the plug 42 allow the contents of the cartridge 10 to flow outward.

The nozzle 34 may be surrounded by a circular ring 50 to stiffen the dispensing fitment 24 and protect the nozzle 34. Optional support walls 52 may connect the ring 50 to the annular side wall 28.

A key aspect of the invention is that, at least in the closed position, the nozzle 34 does not extend upwardly beyond the plane defined by the top of the dispensing fitment closure flange 30. In other words, the nozzle 34 is recessed inside the cup-shaped dispensing fitment 24. The recessed nozzle 34 greatly simplifies the packaging, shipping and storing of the cartridges, since the cartridges are substantially cylindrical with no protruding parts.

For example, the cartridges 10 can be packaged and shipped standing up inside a shipping container, since the recessed nozzle 34 is unlikely to be damaged if the top of the shipping container becomes depressed or collapses. By contrast, conventional cartridges are often shipped on their sides to protect the protruding nozzles.

Furthermore, ink cartridges 10 made according to the present invention can be stacked one on top of another during packing, shipping and storage because there are no protruding parts to prevent stacking. Conventional cartridges with protruding nozzles are less easy to stack.

For better control of fluid flow, a nozzle extension 60 may be attached to the nozzle 34 prior to use. The nozzle extension 60 has a base 62 and a substantially cylindrical spout 64 extending upwardly therefrom. Preferably, the base 62 snap fits onto the nozzle cap 38, although any suitable means of attachment will do.

When the nozzle extension 60 is attached to the nozzle 34, the spout 64 protrudes beyond the plane of the closure flange 30, that is, beyond the end of the cartridge 10. FIGS. 1, 2, 5 and 6 show the cartridge 10 with a nozzle extension 60 snap fit onto the nozzle 34. However, in practice, the cartridges 10 are intended to be stored and shipped with the nozzle extension 60 separate from the cartridges 10.

Because the ink cartridge 10 is sealed at either end by the plunger 22 and the dispensing fitment 24, the present invention minimizes the exposure of the ink to the atmosphere, thus minimizing or preventing oxidation of the ink and loss of VOCs to the atmosphere. And because the cartridge 10 can be resealed by depressing the nozzle cap 38, the cartridge 10 can be reused if the contents are not entirely used up, which is particularly advantageous when expensive inks are used. Finally, because the plunger 22 mates closely with the dispensing fitment 24 when the ink is used up, only a very small amount of residual ink, typically 1% or less, is wasted. In addition to saving ink costs, this allows the container to be placed into a land fill disposal system.

Thus the present invention provides a cartridge for dispensing ink or other viscous extrudable material having a recessed nozzle for ease of packaging, shipping and storing and an optional nozzle extension for better control of material flow. The cartridge minimizes exposure of the ink to the atmosphere and also minimizes the amount of residual ink left in the cartridge after use. The present invention is particularly suitable as an ink dispenser for use with a sheet fed lithographic press having an automatic ink level sensor.

Other modifications and alternative embodiments of the invention are contemplated which do not depart from the spirit and scope of the invention as defined by the foregoing teachings and appended claims. It is intended that the claims cover all such modifications that fall within their scope.

We claim as our invention:

1. In a cartridge-type dispenser comprising a hollow cylindrical body for holding a supply of extrudable fluid contents, the cylindrical body having a dispensing end and a plunger end, the plunger end being closed by a plunger adapted to serve as a piston within the cylindrical body to extrude the contents of the dispenser when the plunger is forced toward the dispensing end, the dispensing end terminating in a rim, the improvement comprising:

a generally cup-shaped dispensing fitment mounted in sealing engagement with the dispensing end of the cylindrical body, said dispensing fitment comprising:

a substantially circular disk;

an annular side wall formed around the periphery of the disk and extending upwardly therefrom toward the rim and terminating in a top end, said annular side wall defining a cylindrical area;

a flange extending radially outwardly from the top end of the annular side wall, said flange resting on top of and abutting the rim of the cylindrical body, said flange having a top surface defining a plane;

a substantially circular aperture disposed approximately at the center of the disk communicating with the inside of the cylindrical body; and a reclosable nozzle disposed in the cylindrical area defined by the dispensing fitment side wall and mounted over the aperture, said nozzle having an open and a closed position, wherein the nozzle in the closed position does not extend beyond the plane defined by the top surface of the flange.

2. The dispenser of claim 1 further comprising a detachable nozzle extension which, when attached to the nozzle, extends beyond the plane of the flange.

3. The dispenser of claim 2 wherein the nozzle extension forms a snap fit over the nozzle.

4. The dispenser of claim 1 wherein the cylindrical body is made substantially from convolutely wound paper lined internally with polymeric material.

5. The dispenser of claim 1 wherein the dispensing fitment annular side wall is glued to the inside of the cylindrical body.

* * * * *